US006767124B2

(12) United States Patent
Shikami et al.

(10) Patent No.: US 6,767,124 B2
(45) Date of Patent: Jul. 27, 2004

(54) SLURRY MIXING FEEDER AND SLURRY MIXING AND FEEDING METHOD

(75) Inventors: Satoshi Shikami, Okayama (JP); Masato Kawasaki, Okayama (JP)

(73) Assignee: m•FSI Ltd., Tokyo (JP)

( * ) Notice: Subject to any disclaimer, the term of this patent is extended or adjusted under 35 U.S.C. 154(b) by 161 days.

(21) Appl. No.: 10/174,991

(22) Filed: Jun. 20, 2002

(65) Prior Publication Data

US 2003/0031086 A1 Feb. 13, 2003

(30) Foreign Application Priority Data

Jun. 21, 2001 (JP) ..... 2001-188589

(51) Int. Cl.[7] ..... B01F 15/02
(52) U.S. Cl. ..... 366/152.2; 366/160.2
(58) Field of Search ..... 366/160.2, 160.1, 366/162.2, 152.1, 136, 137, 181.1, 182.1, 182.2, 151.1; 137/7, 14

(56) References Cited

U.S. PATENT DOCUMENTS 3,166,020 A * 1/1965 Cook ..... 417/198
3,830,473 A * 8/1974 Lieferman et al. ..... 366/136
4,096,586 A * 6/1978 Badertscher et al. ..... 366/136
4,242,841 A * 1/1981 Ushakov et al. ..... 451/446
4,773,764 A * 9/1988 Colombani et al. ..... 366/160.2
5,476,320 A * 12/1995 Taguchi et al. ..... 366/152.1
5,478,435 A * 12/1995 Murphy et al. ..... 438/693
6,102,782 A * 8/2000 Custer et al. ..... 451/67
6,224,252 B1 * 5/2001 Munroe et al. ..... 366/132
6,247,903 B1 * 6/2001 Wong ..... 417/279
6,267,142 B1 * 7/2001 Wong et al. ..... 137/605
6,554,467 B2 * 4/2003 Snyder et al. ..... 366/348

FOREIGN PATENT DOCUMENTS

JP 2000-202774 7/2000

* cited by examiner

*Primary Examiner*—Tony G. Soohoo
(74) *Attorney, Agent, or Firm*—Oblon, Spivak, McClelland, Maier & Neustadt, P.C.

(57) ABSTRACT

A mixing feeder is disclosed for a slurry that contains liquids at a desired mixing ratio. The liquids include at least a dispersion of fine abrasive particles and a solution of an additive. The slurry mixing feeder has suction ports for sucking the liquids from a reservoir; a discharge port for feeding the slurry to the chemical mechanical polishing machine; feed pumps arranged in feed lines for the respective liquids, the feed lines extending from the individual suction ports to the discharge port, for sucking the individual liquids in specific amounts to give the mixing ratio and delivering the thus-sucked liquids toward the discharge port; and dampers and pressure-regulated restrictors arranged in combination in the feed lines on delivery sides of the feed pumps, respectively.

8 Claims, 8 Drawing Sheets

SLURRY MIXING FEEDER AND SLURRY MIXING AND FEEDING METHOD

BACKGROUND OF THE INVENTION a) Field of the Invention

This invention relates to a slurry mixing feeder for feeding a slurry, which contains at least a dispersion of fine abrasive particles and a solution of one or more additives at a desired mixing ratio, to a chemical mechanical polishing machine which with high precision, polishes and flattens a surface of a substrate such as a wafer, and also to a slurry mixing and feeding method making use of the slurry mixing feeder.

b) Description of the Related Art

Keeping in step with the move towards high-integration, high-performance LSIs in recent years, there are increasing interests in the chemical mechanical polishing (CMP) method as a processing method for flattening surfaces of substrates, such as wafers, with high precision. In this polishing method, a slurry is used. This slurry is prepared by mixing a solution, which contains a surfactant and a noxidizing agent for promoting chemical action, such as aqueous hydrogen peroxide or iron nitrate, (hereinafter called an "additive solution"), as needed depending upon a material to be polished, with a dispersion of fine abrasive particles (hereinafter called a "stock slurry") The stock slurry can be obtained by dispersing polishing abrasive particles, which are composed of fine particles of silica, alumina, zirconia, manganese dioxide, ceria (cerium oxide) or the like, in an aqueous alkaline solution of potassium hydroxide, ammonia or the like or in surfactant-containing water. Therefore, the slurry is a dispersion of polishing abrasive particles and additives, and is used in actual polishing. Excellent polishing of a substrate is achieved owing to the combination of chemical action, which takes place between the additive solution in the slurry and the substrate, and mechanical action between the polishing abrasive particles in the slurry and the substrate.

Upon polishing, for example, a silicon dioxide film (oxide film) as a layer insulation film material on a semiconductor silicon substrate by the above-described chemical mechanical polishing machine, a slurry is used. To prepare this slurry, an aqueous alkaline solution, for example, an aqueous solution of potassium hydroxide is added to a silica-particle-containing stock slurry to improve the dispersion property of the silica particles and also to bring the silica particles into a flocculated state optimal to the polishing. The slurry is fed onto the semiconductor silicon substrate mounted on the chemical mechanical polishing machine, and by the silica particles in the slurry and a polishing pad of the polishing machine, mechanical polishing is then performed to remove the oxide film.

In polishing a tungsten metal film as a conductor material, on the other hand, an alumina slurry is used. This alumina slurry is prepared by adding aqueous hydrogen peroxide as an oxidizing agent to a stock slurry which contains alumina particles. By feeding the alumina slurry onto a semiconductor silicon substrate mounted on a chemical mechanical polishing machine, a chemical reaction is induced between a surface of the tungsten metal film and hydrogen peroxide to form a tungsten oxide film polishing of which is easy. The film formed through the reaction is then mechanically polished by the alumina particles, as polishing abrasive particles, and a polishing pad of the polishing machine to remove unnecessary parts other than conductor portions.

As a method for feeding a slurry to such a chemical mechanical polishing machine as described above, it has been a conventional practice to mix a stock slurry, which contains polishing abrasive particles chosen as desired, an additive solution with a surfactant, an oxidizing agent and the like contained therein, and further, diluting water, which may be used as needed, at a predetermined ratio in advance, and subsequent to temporary accumulation in a storage tank, to feed the mixture (slurry) to the polishing machine. This method is, however, accompanied by a problem in that the slurry cannot be fed adequately in a good form suited for polishing and moreover, at a desired mixing ratio, because after the mixing, that is, during the accumulation in the storage tank, deteriorations occur in the polishing characteristics of the slurry and the dispersion property of the fine polishing particles in the slurry is lowered, both with time, and the method has low flexibility and applicability when changing the mixing ratio of the slurry components. With a view to overcoming the above-mentioned problem, a slurry feeder is proposed, for example, in JP 2000-202774 A. According to this slurry feeder, an aqueous solution of abrasive particles (stock slurry) and an additive solution are combined in a mixer immediately before injection onto a turntable of a polishing machine, and the plural solutions are then fed as a slurry.

According to an investigation by the present inventors, however, the slurry feeder disclosed in JP 2000-202774 A referred to in the above has been found to involve problems to be described hereinafter. In the slurry feeder, the mixing accuracy of a slurry relies only upon flow meters and constant flow-rate valves openings of which are feedback controlled by the flow meters. In view of the accuracy of the flow meters, substantial errors occur at the flow meters especially in a low flow-rate range. At the constant flow-rate valves, on the other hand, there is a potential problem of blocking with the stock slurry. In some instances, this construction may not be able to adequately feed a slurry of a specific mixing ratio suited for desired processing. In the above-described conventional apparatus, plural solutions are fed to the apparatus by pumps, respectively. According to an investigation by the present inventors, it has also been found that the system has difficulty in maintaining the mixing accuracy of a slurry at high level because pulsation (pressure fluctuations) of the pumps employed in the conventional apparatus adversely affects the maintenance of constant flow rates by the constant flow-rate valves. Further, the above-described conventional apparatus is not equipped with any cleaning means for the part where mixing is performed. If blocking takes place at the internal piping of the apparatus due to settling or flocculation of fine particles in the slurry while a mixed solution is not used, the fine particles so settled or flocculated cannot be eliminated. A problem is believed to remain unsolved in accurately maintaining a liquid mixing ratio especially in an initial stage after resumption of slurry feeding.

SUMMARY OF THE INVENTION

An object of the present invention is, therefore, to provide a slurry mixing feeder, which can adequately feed to a chemical mechanical polishing machine a slurry at a desired flow rate suited for intended processing, at a high-accuracy mixing ratio and in a good form free of deteriorations.

Another object of the present invention is to provide a slurry mixing and feeding method, which can adequately feed to a chemical mechanical polishing machine a slurry at a desired flow rate suited for intended processing, at a high-accuracy mixing ratio and in a good form free of deteriorations.

A further object of the present invention is to provide a slurry mixing feeder, which can maintain a liquid mixing ratio of a slurry at high accuracy even in an initial stage when feeding of the slurry is resumed subsequent to a temporary stop.

The above-described objects can be achieved by the present invention to be described hereinafter. Described specifically, the present invention, in one aspect thereof, provides a slurry mixing feeder for feeding a slurry to a chemical mechanical polishing machine, said slurry containing liquids at a desired mixing ratio, said liquids including at least a dispersion of fine abrasive particles and a solution of an additive, comprising suction ports for sucking the liquids, respectively, a number of the suction ports corresponding to that of the liquids; a discharge port for feeding the slurry to the chemical mechanical polishing machine; feed pumps arranged in feed lines for the respective liquids, said feed lines extending from the individual suction ports to the discharge port, for sucking the individual liquids in specific amounts to give the mixing ratio and delivering the thus-sucked liquids toward the discharge port; and dampers and pressure-regulated restrictors arranged in combination in the feed lines on delivery sides of the feed pumps, respectively.

The slurry may preferably comprise the dispersion of the fine abrasive particles, the solution of the additive and pure water at a desired mixing ratio. Preferably, the slurry mixing feeder may further comprise a means for circulating at least the dispersion of the fine abrasive particles, out of the individual liquids sucked through the suction ports, at a flow rate and pressure equal to or higher than specific rate and pressure at which the dispersion of the fine abrasive particles is consumed at the chemical mechanical polishing machine and a controller for correcting a delivery rate of at least the dispersion of the fine abrasive particles from its corresponding feed pump on a basis of values obtained by continuously measuring pressure fluctuations of the a circulating flow of the dispersion of the fine abrasive particles. Also preferably, the slurry mixing feeder may further comprise a feed line for feeding pure water to the feed line for the dispersion of the fine abrasive particles such that the feed line for the dispersion of the fine abrasive particles can be cleaned with the pure water. The feed pumps may preferably be tubular diaphragm pumps. It may also be preferred that the slurry mixing feeder further comprises a means for transmitting information on a liquid mixing ratio of the slurry, said liquid mixing ratio being desired by the chemical mechanical polishing machine, from the chemical mechanical polishing machine to the feed pumps.

The present invention, in another aspect thereof, also provides a slurry mixing and feeding method for feeding, to plural chemical mechanical polishing machines, slurries desired by the polishing machines, respectively, which comprises connecting slurry mixing feeders of one of the above-described embodiments to the individual chemical mechanical polishing machines, respectively, such that liquids comprising at least a dispersion of fine abrasive particles and a solution of an additive are fed in a parallel manner to the individual chemical mechanical polishing machines via their corresponding slurry mixing feeders. In this slurry mixing and feeding method, it is particularly preferred to use slurry mixing feeders each of which circulates at least the dispersion of the fine abrasive particles (stock slurry) through a pump and is equipped with a controller constructed such that the delivery rate of the stock slurry from a feed pump is corrected on a basis of values obtained by continuously measuring pressure fluctuations of the a circulating flow of the stock slurry.

According to the slurry mixing feeder of the present invention, a slurry formed of plural liquids, which include a stock slurry with fine abrasive particles dispersed therein, can be adequately fed in a deterioration-free good form to the chemical mechanical polishing machine while feeding the individual liquids at desired delivery flow rates and maintaining a high-accuracy mixing ratio.

According to the slurry mixing and feeding method of the present invention, the above-described excellent advantageous effects can be obtained even when plural liquids, which include a feed slurry with fine abrasive particles dispersed therein, are mixed and fed in a parallel manner to plural chemical mechanical polishing machines.

When the slurry mixing feeder further comprises the feed line for feeding pure water to the feed line for the dispersion of the fine abrasive particles such that the feed line for the dispersion of the fine abrasive particles can be cleaned with the pure water, the liquid mixing ratio of a slurry can be maintained highly accurate even in an initial stage after resumption of feeding of the slurry subsequent to a stop of operation. In this case, use of an automated cleaning system makes it possible to provide a slurry mixing feeder maintenance of which is easy.

DETAILED DESCRIPTION OF THE INVENTION AND PREFERRED EMBODIMENTS

Based on certain preferred embodiments of the present invention, the present invention will be described in detail. The present inventors have proceeded with an extensive investigation to solve the above-described problems of the conventional art. In view of the potential problem that the conventional slurry feeders in each of which a stock slurry and an additive solution are mixed immediately before a chemical mechanical polishing machine may not be able to mix these slurry and solution together at a highly-accurate mixing ratio and hence to feed a slurry in a stable state, the present inventors thought that the liquid mixing ratio of a slurry, which is composed of liquids including at least the stock slurry and the additive solution, would be successfully controlled with high accuracy if a means is developed for reducing to the minimum fluctuations of delivery flow rates from pumps upon feeding these slurry and solution and the delivery flow rates from the pumps are stabilized. Based on this thought, the present inventors have proceeded with a further investigation, leading to the present invention.

According to the investigation by the present inventors, plural liquids to be fed to their corresponding feed pumps in a mixing feeder have their own optimal pressure conditions, and delivery flow rate characteristics of the feed pumps vary firstly depending upon pressure fluctuations of the individual liquids to be fed. These pressure fluctuations include those caused by pulsation, which occur when pumps are used for feeding the respective liquids, and those caused by influence as a result of use of the liquids at other polishing machines when the liquids are fed in a parallel manner to plural chemical mechanical polishing machines. Being interested in the possibility that minimization of these pressure fluctuations would become an effective means for minimizing fluctuations in the delivery flow rates from the feed pumps for the individual liquids, the present inventors have proceeded with development work. As a result, it has been found that the below-described two means are effective and use of these means makes it possible to adequately feed a slurry at a desired flow rate suited for intended processing, at a high-accuracy mixing ratio, in a deterioration-free, good form to a chemical mechanical polishing machine.

Figure 1:
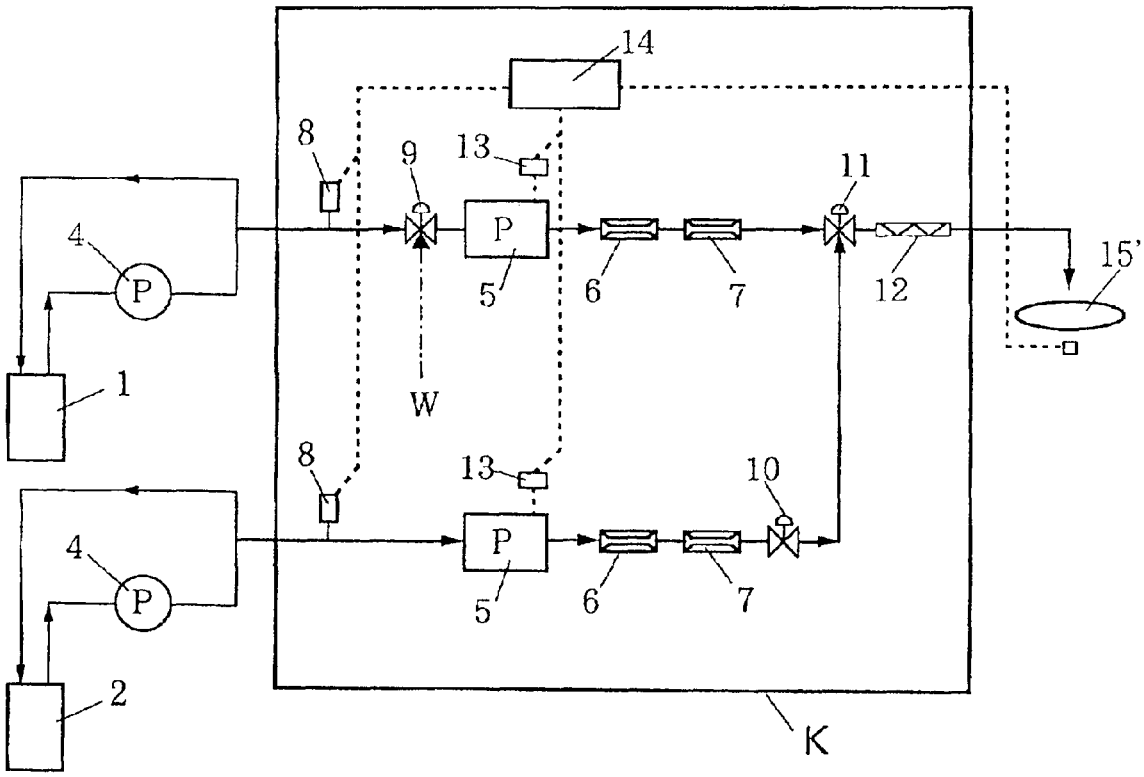
FIG. 1 is a schematic block diagram of a slurry mixing feeder according to a first embodiment of the present invention.

One of the two means is to minimize pulsation which takes place in association of the feeding of liquid by each feed pump. This means will be described based on FIG. 1. In FIG. 1, a feed slurry A supplied from a drum 1 and an additive slurry B supplied from a drum 2 are mixed, and are fed in desired specific amounts to a chemical mechanical polishing machine 15. In the embodiment illustrated in FIG. 1, the stock slurry A and the additive slurry B are both circulated by their corresponding pumps 4. It should however be borne in mind that the present invention is not limited to the use of the pumps 4 and the slurries may be fed under force. This embodiment makes combined use of feed pumps 5 and dampers 6, and further uses pressure-regulated restrictors 7 in combination. Each feed pump 5 sucks a specific amount of the corresponding one of the feed slurry and the additive solution, and delivers and feeds the feed slurry or additive solution in the specific amount toward the chemical mechanical polishing machine 15. Each damper 6 serves to reduce pulsation of the associated pump. According to this means, pulsation of each feed pump 5 is significantly reduced, so that the amount of the stock slurry or additive solution delivered from the feed pump 5 toward the chemical mechanical polishing machine 15 is maintained stable to permit feeding of a slurry at a high-accuracy mixing ratio.

The other means is to incorporate the below-described control system for controlling drive voltages to be supplied to the feed pumps. This means will be described based on FIG. 1. According to this means, amounts of the stock slurry and additive solution to be fed to the chemical mechanical polishing machine 15 are inputted as required flow rates to a slurry mixing feeder K. These required flow rates are processed by a programmable logic controller 14 (hereinafter abbreviated as "PLC") in accordance with delivery rate computing equations obtained before hand for the respective pumps, respectively, and are then transmitted as drive voltages to the corresponding feed pumps 5 via a controller 13. As described above, the delivery rate characteristic of each feed pump 5 varies depending upon fluctuations in the pressure of a flow of the stock slurry or additive solution sucked into the feed pump 5. For example, the stock slurry A, on the other hand, which is to be fed to the feed pump 5 is circulated through the corresponding pump 4 as shown in FIG. 1 at a flow rate and pressure higher than specific values at which it is consumed by the chemical mechanical polishing machine to avoid settling of polishing abrasive particles. Therefore, the stock slurry to be introduced into the corresponding feed pump 5 is unavoidably associated with fluctuations in pressure due to pulsation or the like of the corresponding pump 4 through which the stock slurry is circulated. In this embodiment, this problem is overcome by incorporating a correction system for drive voltages, which are to supplied to the feed pumps 5, such that the above-described fluctuations in pressure can be eliminated or reduced. Described specifically, fluctuations in the pressure of each of the stock slurry and additive solution, said slurry or solution being circulated by the corresponding pump 4 shown in FIG. 1, are continuously monitored on a supply (upstream) side of the corresponding feed pump 5 by a corresponding sensor 8. Measurement values by the sensor 8 are transmitted to PLC 14, and are used as variables in the above-described corresponding computing equation. A corrected computation result is fed back to the drive voltage to be supplied to the corresponding feed pump 5. As a consequence, the delivery flow rate of the feed pump 5 to the chemical mechanical polishing machine 15 is corrected to a good level.

In the feed system of each of the stock slurry and additive solution to the chemical mechanical polishing machine 15, said feed system being arranged in the slurry mixing feeder K according to this embodiment, the stock slurry or additive solution is sucked in a desired specific amount and fed toward the chemical mechanical polishing machine 15 by the associated feed pump 5 as described above. Upon feeding the stock slurry and additive solution toward the chemical mechanical polishing machine 15, the states of their delivery from the feed pumps 5 are controlled by making combined use of the dampers 6 and pressure-regulated restrictors 7, and preferably the above-described correction system. This combination makes it possible to maintain the mixing ratio of the stock slurry and additive solution highly accurate and to achieve stable feeding of the slurry in a deterioration-free form to the chemical mechanical polishing machine.

In the present invention, the slurry mixing feeder of the above embodiment can be provided with a cleaning system such that the feed line of the stock slurry can be cleaned with pure water. This cleaning system can solve the blocking problem of the internal piping of the mixing feeder due to settling and/or flocculation of particles in the slurry during feeding stand-by time, and hence, can also maintain the liquid mixing ratio of the slurry highly accurate even in an initial state after resumption of the feeding subsequent to a temporary stop. Although the above-described cleaning system with pure water may be operated manually, it can be provided as an automated cleaning system. Use of such an automated cleaning system can further facilitate maintenance work.

In the slurry mixing feeder according to this embodiment, the desired flow rate required by the chemical mechanical polishing machine can be inputted directly to a main unit of the slurry mixing feeder or by an external transfer via a network from the chemical mechanical polishing machine to which the slurry is fed. Because adoption of the above-described inputting method by the external transfer permits a remote control to appropriately control the state of feeding of the slurry while watching the state of chemical mechanical polishing, it is possible to achieve improvements in operability and also more complete flatness for a substrate under polishing.

Figure 3:
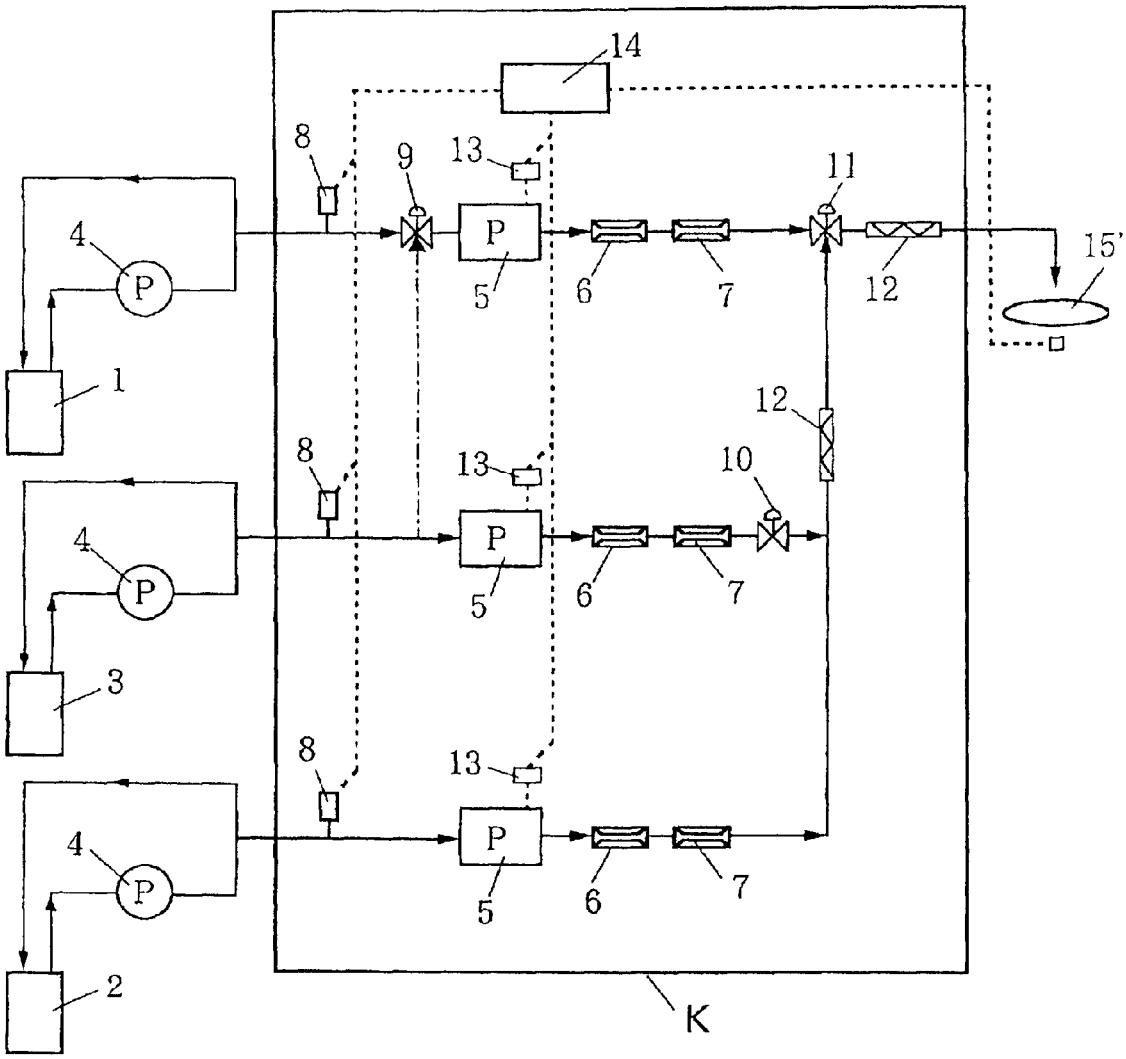
FIG. 3 is a schematic block diagram of a slurry mixing feeder according to a second embodiment of the present invention.

With reference to FIGS. 1 and 3, the slurry mixing feeder according to the first embodiment of the present invention and the slurry mixing feeder according to the second embodiment of the present invention will hereinafter be described in further detail. FIG. 1 illustrates a two-liquid mixing feeder for mixing two liquids together, while FIG. 3 depicts a three-liquid mixing feeder for mixing three liquids together. On liquids to be mixed to form a slurry in the present invention, no particular limitation is imposed insofar as they include at least a stock slurry and an additive solution. Plural liquids can be used including, for example, a combination of a stock slurry with two or more additive solutions, a combination of two or more stock slurries and an additive solution, and combinations of such combinations with pure water for diluting them.

In FIGS. 1 and 3, numeral 1 indicates a drum with a stock slurry (hereinafter called "the liquid A") sealed therein, and numeral 2 designates a drum with an additive solution (hereinafter called "the liquid B") sealed therein. The liquid A contains fine abrasive particles such as silica, alumina or ceria in a form dispersed in water in which a surfactant and/or the like is contained. The liquid B is to be mixed with the liquid A and contains additives such as a surfactant and an oxidizing agent. Designated at numeral 3 is a drum in which pure water (hereinafter called "the liquid C") is sealed. In the feeder illustrated in FIG. 3, the liquid C is used to dilute or mix the liquid A or the liquid B into a suitable form, or to clean the interior of the piping for the liquid A. In the case of the two-liquid mixing feeder shown in FIG. 1, cleaning pure water W is exclusively used for cleaning the interior of the piping for the liquid A. Numeral 4 indicates pumps for circulating the liquids A, B and C, respectively. As the pumps 4, general-purpose pumps such as diaphragm pumps can be used. It is also a preferred embodiment to arrange unillustrated pulsation-reducing dampers in combination with the pumps 4.

A description will next be made of flows of the individual liquids. Firstly, the stock slurry as the liquid A is, as illustrated in FIGS. 1 and 3, sucked from the drum land delivered back to the drum 1, by the pump 4, so that the stock slurry is circulated at a specific flow rate. Among the individual liquids used for the formulation of the slurry, the stock slurry, in particular, involves a potential problem that fine abrasive particles contained therein may settle. As in the embodiments shown in FIGS. 1 and 3, it is preferred to adopt a construction such that the stock slurry is fed to the corresponding feed pump 5 after bringing it into the state of a circulating flow. In the embodiments depicted in FIGS. 1 and 3, a required flow rate signal from PLC 14 is converted into a drive voltage at a controller 13 and is transmitted to the feed pump 5. The feed pump 5 is then driven. The liquid A which is circulating at a specific flow rate is caused to pass through a valve 9 and is fed to the feed pump 5, and is then delivered from the feed pump 5. At this time, effects of fluctuations in the pressure of the circulating flow of the liquid A on the delivery rate of the liquid A from the feed pump 5 are appropriately dealt with by monitoring the pressure fluctuations with the pressure sensor 8 and feeding information on them back to the feed pump 5 by PLC 14. The liquid A, which has been delivered at a specific flow rate from the feed pump 5 as described above, flows further through the damper 6 and the pressure-regulated restrictor 7. As a result, pulsation of the feed pump 5 is reduced, and in this state, the liquid A reaches the valve 11.

In each of the embodiments illustrated in FIGS. 1 and 3, the liquid B is also sucked from the drum 2 and delivered back to the drum 2, and is circulated at a specific flow rate, by the pump 4, in a similar manner as in the case of the liquid A. Different from the stock slurry as the solution, however, the additive solution as the liquid B, depending upon its kind, may not involve a problem such as settling. Therefore, it is not absolutely necessary to circulate the liquid B by the pump 4. The slurry mixing feeders may be constructed such that the liquid B is fed to the feed pump 5 by a force feed method without using any pump. Effects of fluctuations in the pressure of the flow of the liquid B by the circulation or force feed method are appropriately dealt with by monitoring the pressure fluctuations with the pressure sensor 8 and feeding information on them back to the feed pump 5 by PLC 14. The liquid B, which has been delivered at a specific flow rate from the feed pump 5 as described above, flows further through the damper 6 and the pressure-regulated restrictor 7. As a result, pulsation of the feed pump 5 is reduced, and in this state, the liquid B reaches the valve 11.

In the three-liquid mixing system shown in FIG. 3, the liquid B which has been delivered at a specific flow rate in accordance with a signal transmitted to the feed pump 5 as described above flows through a mixer 12. The liquid C is fed into the feed line for the liquid B through the damper 6 and pressure-regulated valve 7 and the optional valve 10, which is arranged as needed. The liquid B is mixed with the liquid C at the mixer 12, and the resulting mixture reaches the valve In the second embodiment shown in FIG. 3, the liquid C which is mixed with the liquid B is also circulated at a specific flow rate by the corresponding pump 4 in a similar manner as the liquid A. Similarly to the case of the liquid B, the liquid C may be fed to the corresponding feed pump 5 by a force feed method without using the pump. Effects of fluctuations in the pressure of the flow of the liquid C by the circulation or force feed method are appropriately dealt with by monitoring the pressure fluctuations with the pressure sensor 8 and feeding information on them back to the feed pump 5 by PLC 14. In the embodiment shown in FIG. 3, the slurry mixing feeder is constructed such that the liquid C, which has been delivered at the specific flow rate in accordance with a signal transmitted to the feed pump 5, is fed further through the damper 6 and the pressure-regulated restrictor 7 to reduce pulsation of the feed pump 5, reaches the valve 10, and is fed into the feed line for the liquid B.

As illustrated in each of FIGS. 1 and 3, the valve 11 is arranged immediately before the chemical mechanical polishing machine 15. At the valve 11, the liquids which have reached there as described above and include the liquid A and liquid B are mixed together. As the liquids which have reached the valve 11 have each been rendered appropriate and stable in flow rate by the above-described method, their liquid mixture, namely, the resulting slurry has adequately achieved a desired mixing ratio. The slurry discharged in this form from the discharge port of the slurry mixing feeder K passes through the mixer 12 arranged as needed in the feed line extending from the valve 11 to the chemical mechanical polishing machine 15, and is fed onto a turn table 15' of the chemical mechanical polishing machine 15.

Figure 2:
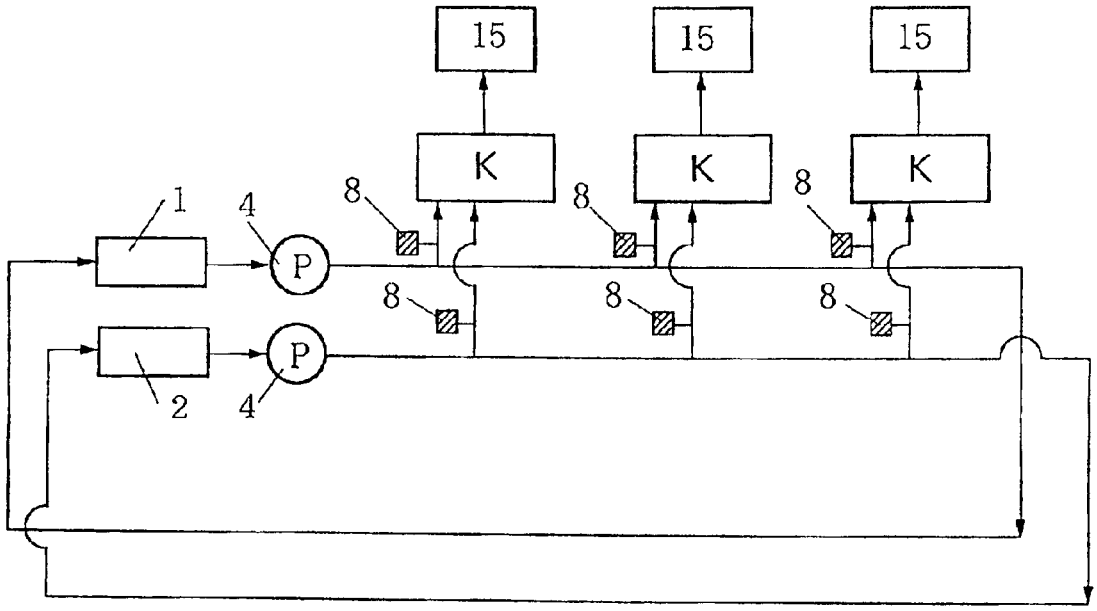
FIG. 2 is a schematic block diagram of a case in which the slurry mixing feeder of FIG. 1 is applied to plural chemical mechanical polishing machines.
Figure 4:
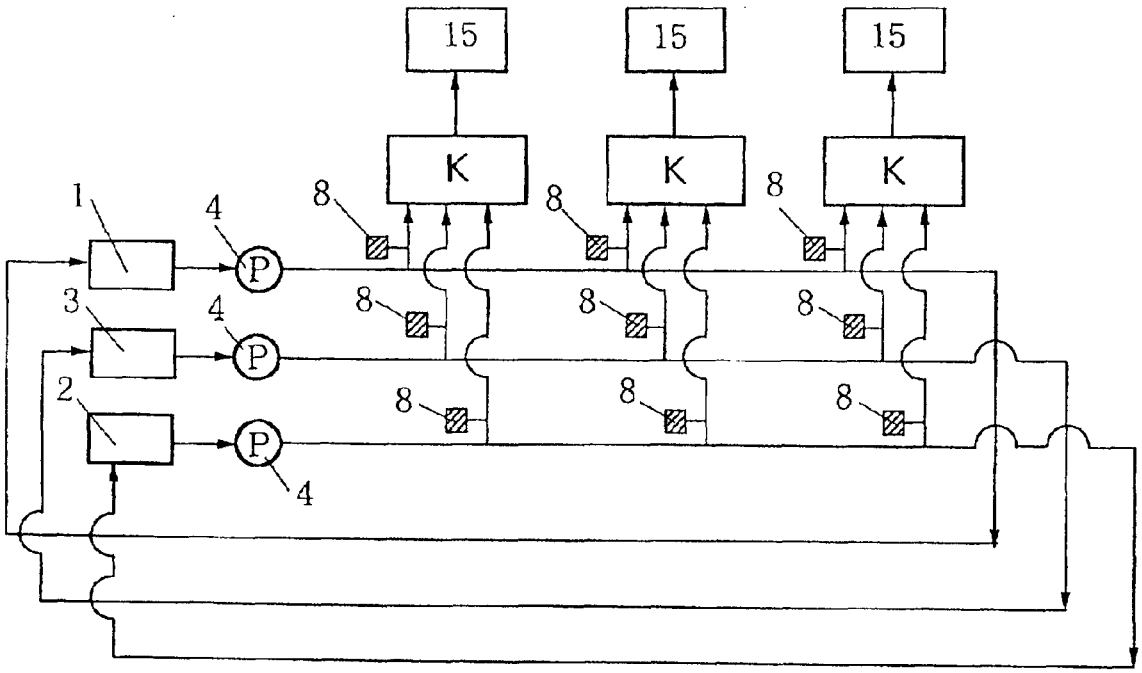
FIG. 4 is a schematic block diagram of a case in which the slurry mixing feeder of FIG. 3 is applied to plural chemical mechanical polishing machines.

When polishing is actually performed by using the slurry mixing feeders K of these embodiments, plural chemical mechanical polishing machines 15 are usually operated at the same time as illustrated in FIGS. 2 and 4. In this case, the plural slurry mixing feeders K (3 feeders in FIGS. 2 and 4) are connected to the above-described circulation lines of the individual liquids and, as illustrated in the drawings, the liquids desired by the respective chemical mechanical polishing machines 15 are fed in parallel. Different from the operation of only one slurry mixing feeder K, operation of the plural mixing feeders K in the above-described manner may develop fluctuations in the pressure of a liquid circulating or force fed on the upstream side of the mixing feeder K, and these fluctuations may result in the development of fluctuations in the pressure of the liquid to be fed to the remaining mixing feeders K.

Since the delivery flow rate characteristic of each liquid from its corresponding feed pump 5 varies depending upon fluctuations in the pressure of the flow of the same liquid to be sucked into the feed pump 5, the fluctuations in the pressure of the flow of the liquid become greater when plural mixing feeders K are connected than when only one plural mixing feeder is operated. This problem becomes serious especially when the liquids to be sucked into the corresponding feed pumps 5 are pumped as circulating flows.

In an embodiment with plural mixing feeders K operated in parallel, it is, therefore, preferred to adopt such a construction that the pressure of each circulated or force fed liquid is continuously monitored by the above-mentioned pressure sensor 8, the measurement value is transmitted to PLC 14, correction by the delivery flow rate computing equation is performed based on the signal, and the computation result so corrected is converted into a signal and fed back to the controller 13 for the feed pump 5. As a result, effects of fluctuations in the pressure of the flow of the liquid on the delivery flow rate of the corresponding feed pump 5 are automatically corrected so that the delivery flow rate is rendered appropriate. Even when a slurry is fed to plural chemical mechanical polishing machines in a parallel manner, the slurry can be adequately fed with highly-accurate liquid mixing ratio to the individual chemical mechanical polishing machines.

Figure 5:
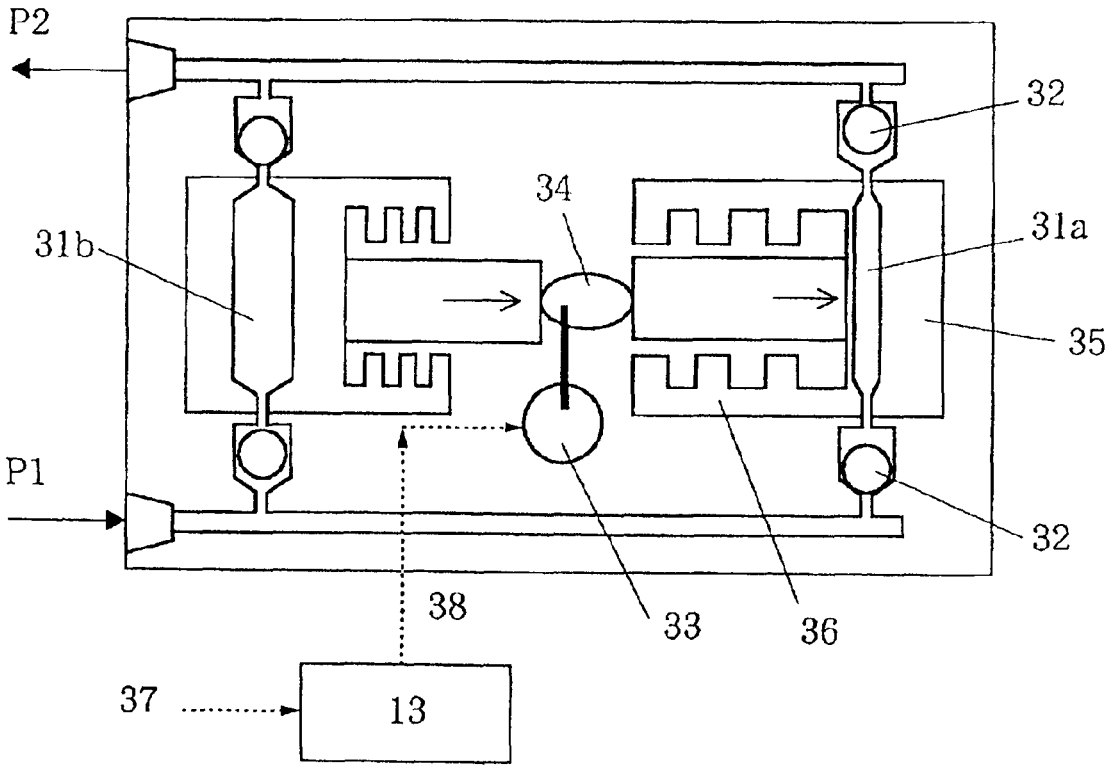
FIG. 5 is a schematic construction diagram of a tubular diaphragm pump useful in the present invention.

As the feed pumps 5 for use in the present invention, use of constant flow-rate pumps is preferred. As constant flow-rate pumps, tubular diaphragm pumps, bellows pumps and diaphragm pumps are generally used. In the present invention, use of such tubular diaphragm pumps as shown in FIG. 5 is preferred. A tubular diaphragm pump has merits that slurry flocculation does not take place and pulsation of the pump itself is smaller compared with those of other pumps. In accordance with the schematic construction diagram shown in FIG. 5, a description will be made about the construction of a tubular diaphragm pump. Check valves 32 are arranged both above and below two tubular diaphragms 31*a*, 31*b*, respectively. By a cam 34 driven by rotation of a motor 33, bellows 36 in actuator sections are caused to change in volume. As a result, the tubular diaphragms 31*a*, 31*b* perform pumping operations via an incompressible fluid 35 such as sealed pure water, for example. Incidentally, a required flow rate signal 37 from PLC (not shown) is converted into a motor drive voltage at the controller 13, and the motor 33 is rotated by the drive voltage.

In FIG. 5, the tubular diaphragm 31*a* is in a compressed form, and the liquid A introduced in a specific amount into the tubular diaphragm 31*a* has been delivered toward P2 (delivery side). At this time, the tubular diaphragm 31*a* is open on the side of P2, but is closed by the check valve 32 on the side of P1 (upstream side). Here, the other tubular diaphragm 31*b* is in a state open on the side of P1 owing to a change in the volume of the bellows 36 of the actuator section, so that a specific amount of the liquid is sucked into the tubular diaphragm 31*b* from the side of P1. At this time, the tubular diaphragm 31*b* is closed on the side of P2 by the check valve 32. In this manner, the specific amounts of the liquid are alternately sucked into the two tubular diaphragms, and are alternately delivered from the tubular diaphragms 31*a*, 31*b*. The liquid is therefore delivered stably at specific flow rate. To reduce pulsation of each feed pump 5, the liquid delivered from the feed pump 5 is caused to flow further through the damper 6 and the pressure-regulated restrictor 7.

As dampers for use in the present invention, any dampers can be used insofar as they can reduce pulsation of the feed pumps 5. For example, it is possible to use those each having such a construction that the interior has a tubular diaphragm structure, a fluid flows through the inside of the tubular diaphragm, air of predetermined pressure is charged from the outside to compress the tubular diaphragm inwards, and this compression damps pressure fluctuations given to the fluid upon its delivery from the feed pump 5 and reduces pulsation to constantly maintain the desired flow rate.

As pressure-regulated valves for use in the present invention, usable examples are those each having such an orifice construction that the interior has a tubular diaphragm structure, a fluid flows through the inside of the tubular diaphragm, and air is charged at a certain pressure from the outside to compress the tubular diaphragm inwards and hence to effect a constriction on the pressure of the fluid on the upstream side of the tubular diaphragm pump. Use of such a tubular diaphragm construction is desired, because damping effect is also expected and pulsation can be damped further.

As the pumps 4, on the other hand, desired ones can be suitably selected from general-purpose pumps, such as diaphragm pumps and bellows pumps, and used.

The present invention will hereinafter be described in still further detail based on Examples.

<Confirmation of Advantageous Effects Available From the Combination of Dampers and/or Pressure-regulated Restrictors With Feed Pumps>

An investigation was conducted for the stability of delivery flow rates by using a mixing feeder of the circuit diagram illustrated in FIG. 3, in which tubular diaphragm pumps (manufactured by IWAKI CO., LTD.) were used as the feed pumps 5 and dampers 6 and further, pressure-regulated restrictors 7 were combined with the pumps 5, and circulating three liquids (pure water was used commonly as the liquids in this investigation). This system will be referred to as "Referential Example 1". Also employed for the sake of comparison were as "Referential Example 2" a mixing feeder similar to Referential Example 1 except that tubular diaphragm pumps were solely arranged without using the dampers 6 and pressure-regulated restrictors 7 and as "Referential Example 3" a mixing feeder similar to Referential Example 1 except that only dampers 6 were combined with tubular diaphragm pumps. In the test, the pressure of pure water was set at 0 MPa without using the pumps 4. This was to avoid effects of pressure fluctuations on the tubular diaphragm pumps. No automatic correction system was employed for pressure fluctuations. As the delivery flow rates from the respective mixing feeders of the above-described constructions, pure waters delivered from the mixing feeders were measured by a graduated metering cylinder to actually determine delivery flow rates per unit time.

Figure 6:
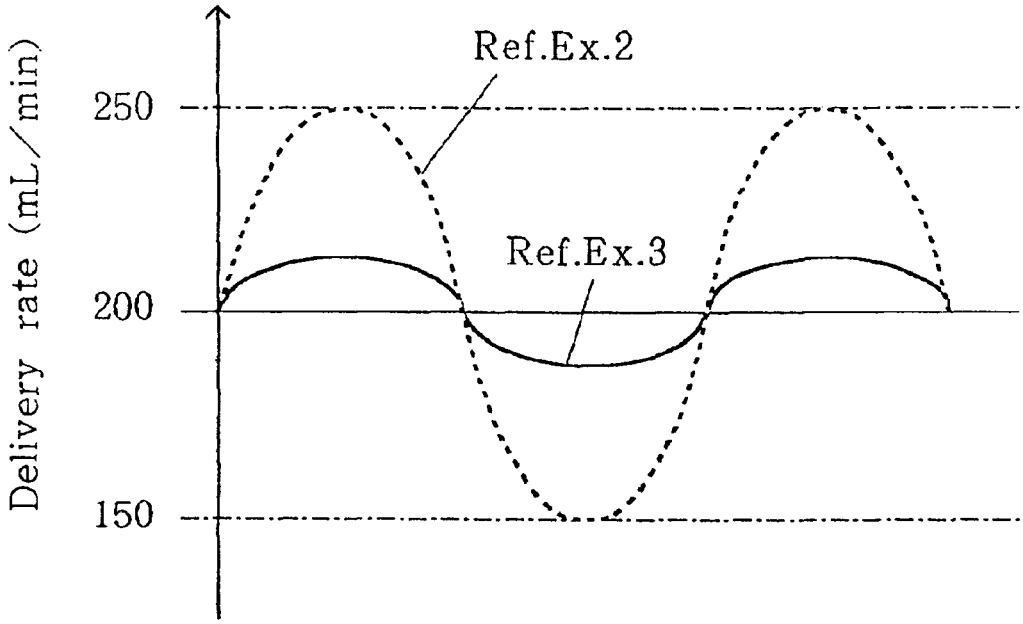
FIG. 6 is a diagrammatic representation of measurement results, which shows an advantageous effect of dampers constituting the slurry mixing feeder according to the second embodiment of the present invention.

FIG. 6 shows time-dependent variations in delivery flow rate per unit time in Referential Examples 2 and 3. As is appreciated from FIG. 6, it was confirmed that fluctuations (extents of changes) in delivery flow rate per unit time were clearly reduced in Referential Example 3, in which the dampers 6 were used, compared with in Referential Example 2 in which the mixing feeder composed solely of the tubular diaphragm pumps was used. To achieve linearity with respect to the delivery flow rate, use of the dampers alone was found to be insufficient.

Figure 7:
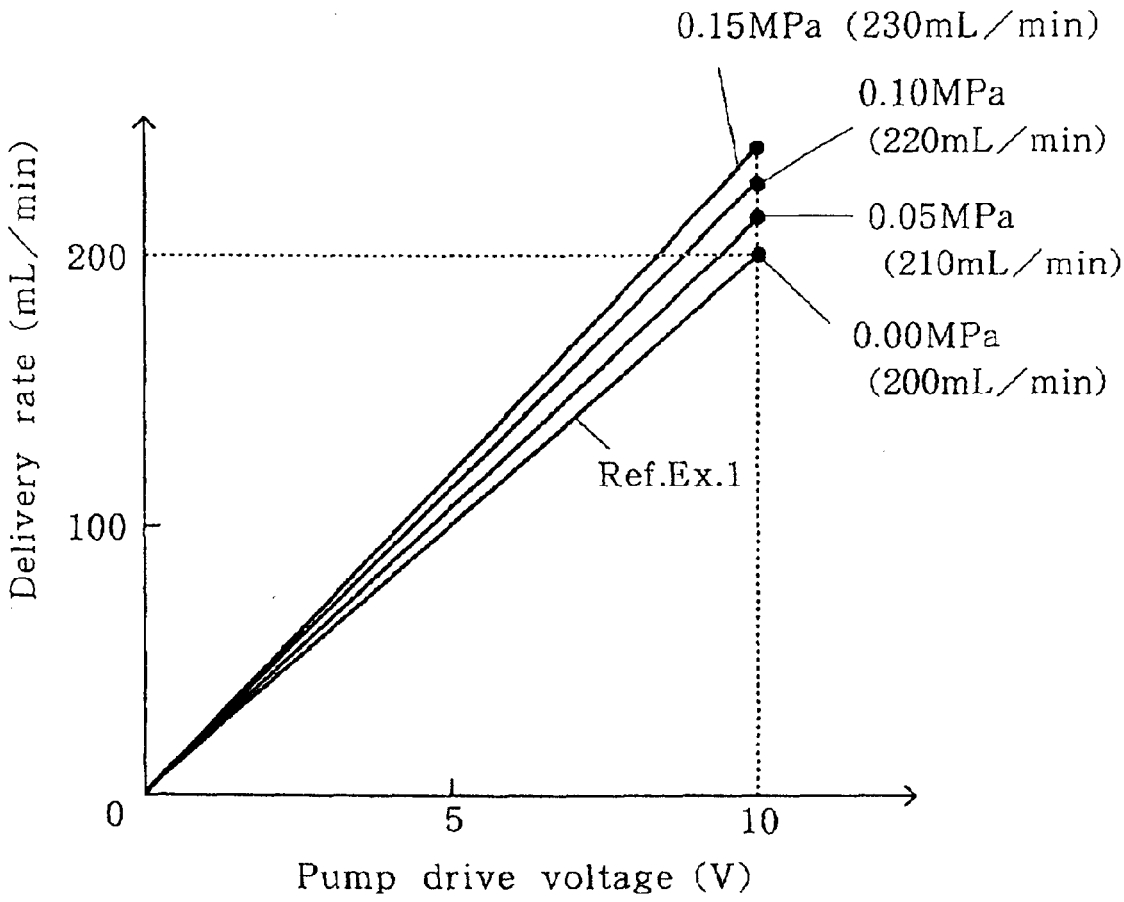
FIG. 7 is a diagrammatic representation of measurement results, which illustrates an advantageous effects of pressure-regulated restrictors constituting the slurry mixing feeder according to the second embodiment of the present invention and also shows errors in delivery flow rate for pressure fluctuations on an upstream side.

FIG. 7 illustrates effects on the delivery flow rate of a tubular diaphragm pump 5 by causing the pressure of pure water to fluctuate. It was confirmed that the delivery flow rate was in a linear proportion with pump drive voltage and also that compared with FIG. 6, the delivery flow rate was clearly stabilized owing to the addition of a pressure-regulated restrictor 7. A similar test was also conducted using the two-liquid mixing feeder shown in FIG. 1. Similar results were obtained.

It was however found that an ideal straight line was obtained when the feeding pressure of pure water was 0 MPa but, as the pressure increased, the inclination of the straight line changed, in other words, the delivery flow rate increased. From this finding, it is expected that, when pressure fluctuations constantly take place in a flow of liquid to be fed, errors always occur in the delivery flow rate. Such a problem is not considered to be completely overcome by the adoption of the dampers 6 and pressure-regulated restrictors 7 alone.

<Confirmation of Effects of Automatic Correction System for Pressure Fluctuations in a Circulated System>

In Referential Examples 1-3 described above, the pressure of pure water was set at 0 Ma. It was, however, expected from the results of FIG. 7 that, when fluctuations occur in the pressure of pure water to be fed to a mixing feeder by circulating the pure water, the delivery flow rate from each tubular diaphragm pump would be affected. Using as Referential Example 4 a system similar to that employed above in Referential Example 1 except that pure water was circulated by using the pumps 4 and as Referential Example 5 a system similar to that of Referential Example 4 except that an automatic correction system was additional used for fluctuations in the pressures of flows of pure water by the pumps, the stability of delivery flow rates in those cases was investigated. In Referential Examples 4 and 5, water was also commonly used as the three liquids.

Figure 8:
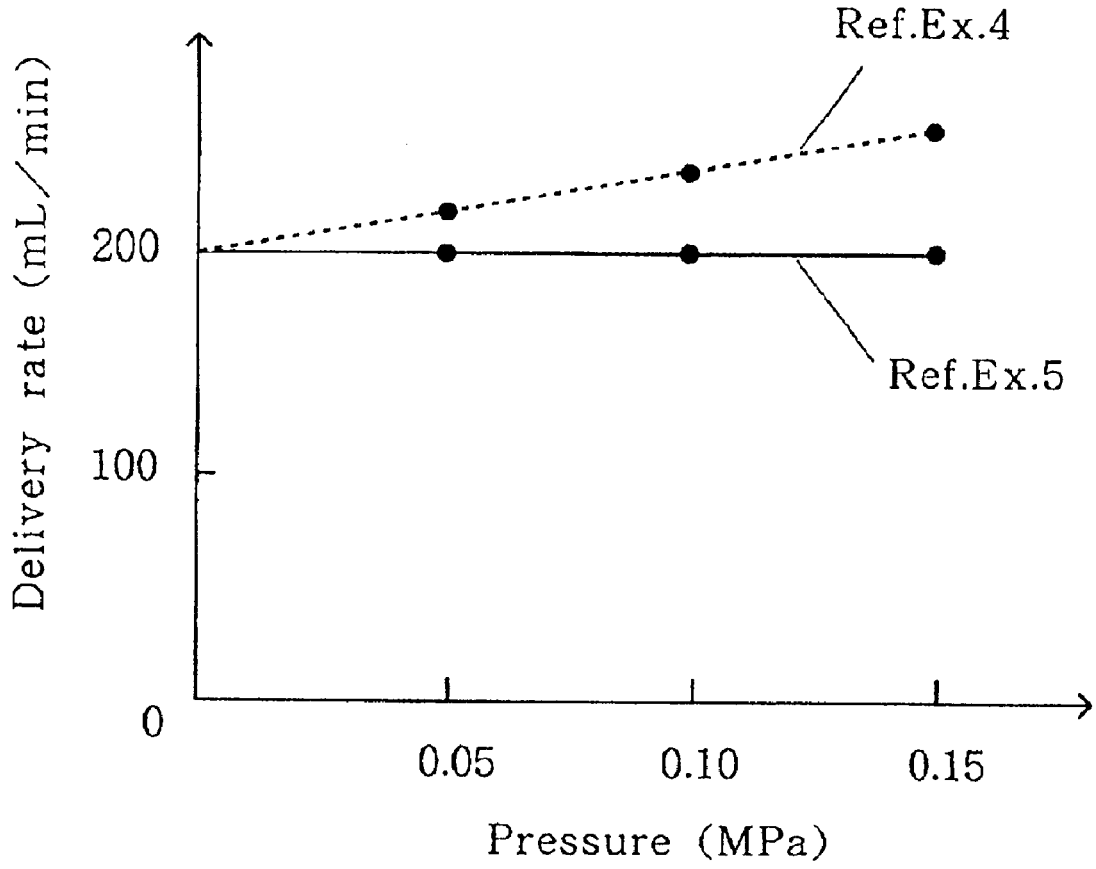
FIG. 8 is a diagrammatic representation of measurement results, which depicts effects of an automatic correction system used in the slurry mixing feeder according to the second embodiment of the present invention.

FIG. 8 shows fluctuations in the delivery flow rates of the tubular diaphragm pumps in Referential Example 5, in which the automatic correction system was used for fluctuations in the pressure of a flow of pure water circulated by the pump 4, and in Referential Example 4 in which such an automatic correction system was not used. As a result, it was confirmed that, even when fluctuations occur in the upstream-side pressure of the liquid fed by the pump 4, the use of the automatic correction system made it possible to maintain constant the delivery flow rate from the tubular diaphragm pump. In other words, even if fluctuations take place in the pressure of a flow of liquid by the pump 4, the delivery flow rate from the feed pump 5 can be maintained at the constant level by monitoring the fluctuations and automatically correcting the delivery flow rate from the feed pump 5. A similar test was also conducted using the two-liquid mixing feeder shown in FIG. 1. Similar results were obtained.

EXAMPLE 1

Employed in Example 1 was a system similar to that used Referential Example 5 except that the liquids employed were changed from pure water to three kinds of liquids, i.e., a silica slurry with fine silica powder dispersed therein (liquid A), aqueous hydrogen peroxide as an oxidizing agent (liquid B) and pure water (liquid C). The individual liquids were circulated by the corresponding pumps 4, and were fed at specific flow rates to the corresponding feed pumps 5. Required flow rates inputted to the individual feed pumps 5 and flow rates from the pumps were then measured. As a result, it was confirmed as shown in Table 1 that, when the specific flow rates at which the corresponding liquids were fed to the respective feed pumps 5 were different and the three liquids were different in properties, stable delivery flow rates were obtained for all the liquids without being affected by fluctuations in the pressures of the liquids on the upstream sides of the feed pumps

TABLE 1

| | Evaluation Results | | | |
|---|---|---|---|---|
| | Liquid Name | Required flow rate (mL/min) | Delivery flow rate (mL/min) | Error (%) |
| Liquid A | Silica slurry | 140 | 137.5 | −1.79 |
| Liquid B | Aqueous hydrogen peroxide | 20 | 20.0 | 0.00 |
| Liquid C | Pure water | 60 | 61.5 | 2.50 |

EXAMPLE 2

Employed in Example 2 was a system similar to that used Referential Example 5 except that the liquids employed were changed from pure water to three kinds of liquids, i.e., a ceria slurry with fine ceria powder dispersed therein (liquid A), a surfactant as an additive (liquid B) and pure water (liquid C). The individual liquids were circulated by the corresponding pumps 4, and were fed at specific flow rates to the corresponding feed pumps 5. With respect to the individual liquids, required flow rates inputted to the individual feed pumps 5 and flow rates from the pumps were then measured. As a result, it was confirmed as shown in Table 2 that, when the specific flow rates at which the corresponding liquids were fed were different and the three liquids were also different in properties, delivery flow rates were stable for all the liquids without being affected by fluctuations in the pressures of the liquids on the upstream sides of the feed pumps 5. Especially, fine ceria powder has high settling tendency, and therefore, extremely difficult control has heretofore been needed for feeding a ceria slurry in a good form to a chemical mechanical polishing machine. As shown in Table 2, however, it has confirmed that a stable delivery flow rate can be maintained even for the ceria slurry (liquid A) and use of a mixing feeder according to the present invention makes it possible to feed a liquid mixture (slurry), which contains a ceria slurry, in a good form to a chemical mechanical polishing machine.

TABLE 2

| | Evaluation Results | | | |
|---|---|---|---|---|
| | Liquid Name | Required flow rate (mL/min) | Delivery flow rate (mL/min) | Error (%) |
| Liquid A | Ceria slurry | 50 | 50.0 | 0.00 |
| Liquid B | Surfactant | 100 | 98.0 | −2.00 |
| Liquid C | Pure water | 50 | 50.5 | 1.00 |

EXAMPLE 3

Under similar conditions as in Example 1, three kinds of liquids, that is, a silica slurry (liquid A), aqueous hydrogen peroxide as an oxidizing agent (liquid B) and pure water (liquid C) were fed in a parallel manner to three chemical polishing machines as illustrated in FIG. 4. Required flow rates inputted to the feed pumps 5 for the individual liquids and delivery flow rates from the feed pumps were investigated. As a result, it was confirmed as shown below in Table 3 that with respect to all the liquids, stable delivery flow rates were obtained from the corresponding feed pumps 5 in response to the required flow rates.

TABLE 3

| Evaluation Results | | | | | |
|---|---|---|---|---|---|
| Polishing machine | | Liquid Name | Required flow rate (mL/min) | Delivery flow rate (mL/min) | Error (%) |
| 1 | Liquid A | Silica slurry | 150 | 151.5 | 1.00 |
| | Liquid B | Aqueous hydrogen peroxide | 30 | 30.5 | 1.67 |
| | Liquid C | Pure water | 50 | 48.5 | −3.00 |
| 2 | Liquid A | Silica slurry | 150 | 148.0 | −1.33 |
| | Liquid B | Aqueous hydrogen peroxide | 30 | 31.0 | 3.33 |
| | Liquid C | Pure water | 50 | 50.0 | 0.00 |
| 3 | Liquid A | Silica slurry | 150 | 152.0 | 1.33 |
| | Liquid B | Aqueous hydrogen peroxide | 30 | 30.0 | 0.00 |
| | Liquid C | Pure water | 50 | 51.0 | 2.00 |

EXAMPLE 4

Subsequent to the completion of the test in Example 2, the operation was stopped and the slurry mixing feeder was left over as was for 1 day. After that, only the feed line for pure water (liquid C) was operated to feed pure water to the feed line for the ceria slurry (liquid A) at a flow rate of 2 L/min for 5 minutes. Subsequently, the slurry mixing feeder was operated under the same conditions as in Example 2. As shown below in Table 4, it was confirmed that as in the test of Example 2, stable delivery rates were successfully obtained from immediately after the resumption of the operation.

TABLE 4

| Evaluation Results | | | | |
|---|---|---|---|---|
| | Liquid Name | Required flow rate (mL/min) | Delivery flow rate (mL/min) | Error (%) |
| Liquid A | Ceria slurry | 50 | 49.5 | −1.00 |
| Liquid B | Surfactant | 100 | 100.5 | 0.50 |
| Liquid C | Pure water | 50 | 48.5 | −3.00 |

EXAMPLE 5

Employed in Example 5 was a system similar to that used Referential Example 5 except that three-liquid mixing feeder shown in FIG. 3 was replaced by the two-liquid mixing feeder depicted in FIG. 1 and the liquids employed were changed to two kinds of liquids, i.e., a silica slurry with fine silica powder dispersed therein (liquid A) and aqueous hydrogen peroxide as an additive (liquid B). The individual liquids were circulated by the corresponding pumps 4, and were fed at specific flow rates to the corresponding feed pumps 5. With respect to the individual liquids, required flow rates inputted to the individual feed pumps 5 and flow rates from the pumps were then measured. As shown in Table 5, it was confirmed that, when the two-liquid mixing feeder was used, the liquids which were different in the specific flow rates at which they were fed to the respective feed pumps 5 and were also different in properties were also fed at stable delivery flow rates without being affected by fluctuations in the pressures of the liquids on the upstream sides of the feed pumps 5.

TABLE 5

| Evaluation Results | | | | |
|---|---|---|---|---|
| | Liquid Name | Required flow rate (mL/min) | Delivery flow rate (mL/min) | Error (%) |
| Liquid A | Silica slurry | 200 | 202.0 | 1.00 |
| Liquid B | Aqueous hydrogen peroxide | 25 | 25.5 | 2.00 |

EXAMPLE 6

A test was conducted in a similar manner as in Example 5 except that the silica slurry was replaced by a ceria slurry (liquid A) with fine ceria powder dispersed therein and a surfactant (liquid B) was used as an additive in place of aqueous hydrogen peroxide. The individual liquids were circulated by the corresponding pumps 4, and were fed at specific flow rates to the corresponding feed pumps 5. With respect to the individual liquids, required flow rates inputted to the individual feed pumps 5 and flow rates from the pumps 5 were then measured. As a result, with respect to both of the liquids, their delivery flow rates from the corresponding feed pumps 5 were stable without being affected by fluctuations in the pressures of the liquids on the upstream sides of the feed pumps 5 as shown in Table 6. It has hence been confirmed that with respect to a liquid mixture (slurry) containing a ceria slurry feeding of which in a good state to a chemical mechanical polishing machine has been very difficult for its considerable settling tendency, stable delivery flow rates of the individual liquids can also be maintained when they are fed by the two-liquid mixing feeder employed in this Example.

TABLE 6

| | Evaluation Results | | | |
|---|---|---|---|---|
| | Liquid Name | Required flow rate (mL/min) | Delivery flow rate (mL/min) | Error (%) |
| Liquid A | Ceria slurry | 75 | 74.0 | −1.33 |
| Liquid B | Aqueous hydrogen peroxide | 150 | 152.5 | 1.67 |

EXAMPLE 7

Under similar conditions as in Example 6, two kinds of liquids, that is, a ceria slurry (liquid A) and a surfactant (liquid B) were fed in a parallel manner to three chemical polishing machines as illustrated in FIG. 2. Required flow rates inputted to the feed pumps 5 for feeding the individual liquids and delivery flow rates from the pumps 5 were investigated. As a result, it was confirmed as shown below in Table 7 that with respect to both of the liquids, stable delivery flow rates were obtained in response to the required flow rates.

TABLE 7

| | Evaluation Results | | | | |
|---|---|---|---|---|---|
| Polishing machine | | Liquid Name | Required flow rate (mL/min) | Delivery flow rate (mL/min) | Error (%) |
| 1 | Liquid A | Ceria slurry | 67 | 68.0 | 1.49 |
| | Liquid B | Surfactant | 133 | 133.5 | 0.38 |
| 2 | Liquid A | Ceria slurry | 67 | 65.5 | −2.24 |
| | Liquid B | Surfactant | 133 | 133.0 | 0.00 |
| 3 | Liquid A | Ceria slurry | 67 | 67.0 | 0.00 |
| | Liquid B | Surfactant | 133 | 135.5 | 1.88 |

EXAMPLE 8

Subsequent to the completion of the test in Example 6, the operation was stopped and the slurry mixing feeder was left over as was for 1 day. After that, pure water was caused to flow to the feed line for the ceria slurry (liquid A) at a flow rate of 2 L/min for 5 minutes. Subsequently, the slurry mixing feeder was operated under the same conditions as in Example 6. As shown below in Table 8, it was confirmed that as in the test of Example 6, stable delivery rates were successfully obtained from immediately after the resumption of the operation.

TABLE 8

| | Evaluation Results | | | |
|---|---|---|---|---|
| | Liquid Name | Required flow rate (mL/min) | Delivery flow rate (mL/min) | Error (%) |
| Liquid A | Ceria slurry | 75 | 76.0 | 1.33 |
| Liquid B | Surfactant | 150 | 148.5 | −1.00 |

This application claims the priority of Japanese Patent Application 2000-188589 filed Jun. 21, 2001, which is incorporated herein by reference.

What is claimed is:

1. A slurry mixing feeder for feeding a slurry to a chemical mechanical polishing machine, said slurry containing liquids at a desired mixing ratio, said liquids including at least a dispersion of fine abrasive particles and a solution of an additive, comprising:

suction ports for sucking said liquids, respectively, a number of said suction ports corresponding to that of said liquids;

a discharge port for feeding said slurry to said chemical mechanical polishing machine;

feed pumps arranged in feed lines for said respective liquids, said feed lines extending from said individual suction ports to said discharge port, for sucking said individual liquids in specific amounts to give said mixing ratio and delivering the thus-sucked liquids toward said discharge port;

dampers and pressure-regulated restrictors arranged in combination in said feed lines on delivery sides of said feed pumps, respectively; and pressure sensors placed on said feed lines between said individual suction ports and said feed pumps, wherein power supplies to said feed pumps are configured to be controlled based on pressure fluctuations of said liquids measured by said pressure sensors.

2. A slurry mixing feeder according to claim 1, wherein said slurry comprises said dispersion of said fine abrasive particles, said solution of said additive and pure water at a desired mixing ratio.

3. A slurry mixing feeder according to claim 1 or 2, further comprising:

a means for circulating at least said dispersion of said fine abrasive particles, out of said individual liquids sucked through said suction ports, at a flow rate and pressure equal to or higher than specific rate and pressure at which said dispersion of said fine abrasive particles is consumed at said chemical mechanical polishing machine; and a controller for correcting a delivery rate of at least said dispersion of said fine abrasive particles from its corresponding feed pump on a basis of values obtained by continuously measuring pressure fluctuations of a circulating flow of said dispersion of said fine abrasive particles.

4. A slurry mixing feeder according to claim 1 or 2, further comprising:

a feed line for feeding pure water to said feed line for said dispersion of said fine abrasive particles such that said feed line for said dispersion of said fine abrasive particles can be cleaned with said pure water.

5. A slurry mixing feeder according to claim 1 or 2, wherein said feed pumps are tubular diaphragm pumps.

6. A slurry mixing feeder according to claim 1 or 2, further comprising:

a means for transmitting information on a liquid mixing ratio of said slurry, said liquid mixing ratio being desired by said chemical mechanical polishing machine, from said chemical mechanical polishing machine to said feed pumps.

7. A slurry mixing and feeding method for feeding, to plural chemical mechanical polishing machines, slurries desired by said polishing machines, respectively, which comprises:

connecting slurry mixing feeders, which are as defined in claim 1 or 2, to said individual chemical mechanical polishing machines, respectively, such that liquids comprising at least a dispersion of fine abrasive particles and a solution of an additive are fed in a parallel manner to said individual chemical mechanical polishing machines via their corresponding slurry mixing feeders.

8. A slurry mixing feeder for feeding a slurry to a chemical mechanical polishing machine, said slurry containing liquids at a desired mixing ratio, said liquids including at least a dispersion of fine abrasive particles and a solution of an additive, said slurry mixing feeder comprising:

a first slurry supply configured to supply slurry under pressure;

a first feed pump in communication with said first slurry supply via a slurry supply line;

a first pressure sensor configured to measure pressure fluctuations in said slurry supply line connecting said first feed pump to said first slurry supply;

a first damper in communication with and downstream of said first feed pump;

a first pressure-regulated restrictor in communication with and downstream of said first damper, said first damper cooperating with said first pressure-regulated restrictor to reduce pulsations of said first feed pump; and a controller configured to control a delivery rate characteristic of said first feed pump based on said measured pressure fluctuations.

* * * * *